US005527401A

United States Patent [19]

Kim

[11] Patent Number: 5,527,401

[45] Date of Patent: Jun. 18, 1996

[54] HIGH TOUGHNESS AND HIGH STRENGTH UNTEMPERED STEEL AND PROCESSING METHOD THEREOF

[75] Inventor: Kang-Hyung Kim, Kyungnam, Rep. of Korea

[73] Assignee: Samsung Heavy Industry Co., Ltd., Rep. of Korea

[21] Appl. No.: 265,068

[22] Filed: Jun. 28, 1994

[30] Foreign Application Priority Data

Jun. 30, 1993 [KR] Rep. of Korea ..... 93-12148
Jun. 28, 1994 [KR] Rep. of Korea ..... 94-14931

[51] Int. Cl.[6] ..... C21D 7/13

[52] U.S. Cl. ..... 148/648; 148/654

[58] Field of Search ..... 146/648; 148/654

[56] References Cited

FOREIGN PATENT DOCUMENTS

| | | | |
|---|---|---|---|
| 58-120727 | 7/1983 | Japan | 148/654 |
| 62-83420 | 4/1987 | Japan | 148/654 |
| 63-183129 | 7/1988 | Japan | 148/654 |

*Primary Examiner*—Deborah Yee
*Attorney, Agent, or Firm*—Lieberman & Nowak

[57] ABSTRACT

The present invention is concerned about high toughness and high strength untempered steel having the mechanical properties equivalent to or better than those of tempered steel and processing method thereof, more particularly, the high toughness and high strength untempered steel having the tensile strength higher than 90 kgf/mm$^2$ with the impact toughness higher than 5 kgf-m/cm$^2$ in the KS 3 specimen, and processing method thereof.

16 Claims, 3 Drawing Sheets

HIGH TOUGHNESS AND HIGH STRENGTH UNTEMPERED STEEL AND PROCESSING METHOD THEREOF

BACKGROUND OF THE INVENTION

1. Field of the Invention

The present invention is concerned with high toughness and high strength untempered steel having the mechanical properties equivalent to or better than those of tempered steel and processing method thereof, more particularly, the high toughness and high strength untempered steel having either the tensile strength higher than 75 kgf/mm$^2$ with the impact toughness higher than 7 kgf-m/cm$^2$ in the KS 3 specimen, or the tensile strength higher than 90 kgf/mm$^2$ with the impact toughness higher than 5 kgf-m/cm$^2$ in the KS 3 specimen, and processing method thereof.

2. Description of the Prior Art

Generally, the untempered steel means the steel which can exhibit the satisfactory mechanical properties in the work-hardened state without heat-treatments such as quenching-annealing and normalizing. However, since the toughness of untempered steel is extremely low compared to that of the tempered steel, its use has been limited to the crank shafts or other simple applications where the toughness is not considered as the important property.

Particularly, as pointed out in Japanese Patent Publication No.89-211606 or Japanese Patent Publication No. 83-53709, U.S. Pat. No. 4,851,054, since the conventional untempered steel exhibits its good mechanical properties only in the products with small diameter or thin plate but not in the products with large diameter, there have been many problems for the actual applications. Moreover, as indicated in U.S. Pat. No. 4,141,761, Japanese Patent Publication No. 79-66322, Japanese Patent Publication No. 83-167751 and Japanese Patent Publication No. 86-56235, the low-carbon and high-alloy steel has been developed, but there has been shortcoming that the induction heat-treatment cannot be performed on the steel.

SUMMARY OF THE INVENTION

It is an object of the present invention to provide high toughness and high strength untempered steel having the mechanical properties of either the tensile strength higher than 75 kgf/mm$^2$ with the impact toughness higher than 7 kgf-m/cm$^2$, or the tensile strength higher than 90 kgf/mm$^2$ with the impact toughness higher than 5 kgf-m/cm$^2$ as well as good electroplating and welding characteristics, on which the surface induction hardening heat-treatment can he performed to imporve the fatigue strength.

It is another object of the present invention to provide the processing method of said high toughness and high strength untempered steel.

In order to accomplish said objects, the high toughness and high strength untempered steel of the present invention comprises by eight percent C; 0.35~0.45, Si; 0.15~0.35%, Mn; 0.80~1.50%, S; 0.005~0.050%, Cr; 0~0.30%, Al; 0.01~0.05%, V+Nb; 0.05~0.15%, 0~0.03%, Ni; 0.006~0.020%, impurities P: 0~0.03%, $O_2$; less than 0.0050%, and Fe and impurities which are inevitably during the steel-making process.

DETAILED DESCRIPTION OF THE PREFERRED EMBODIMENTS

Figure 1:
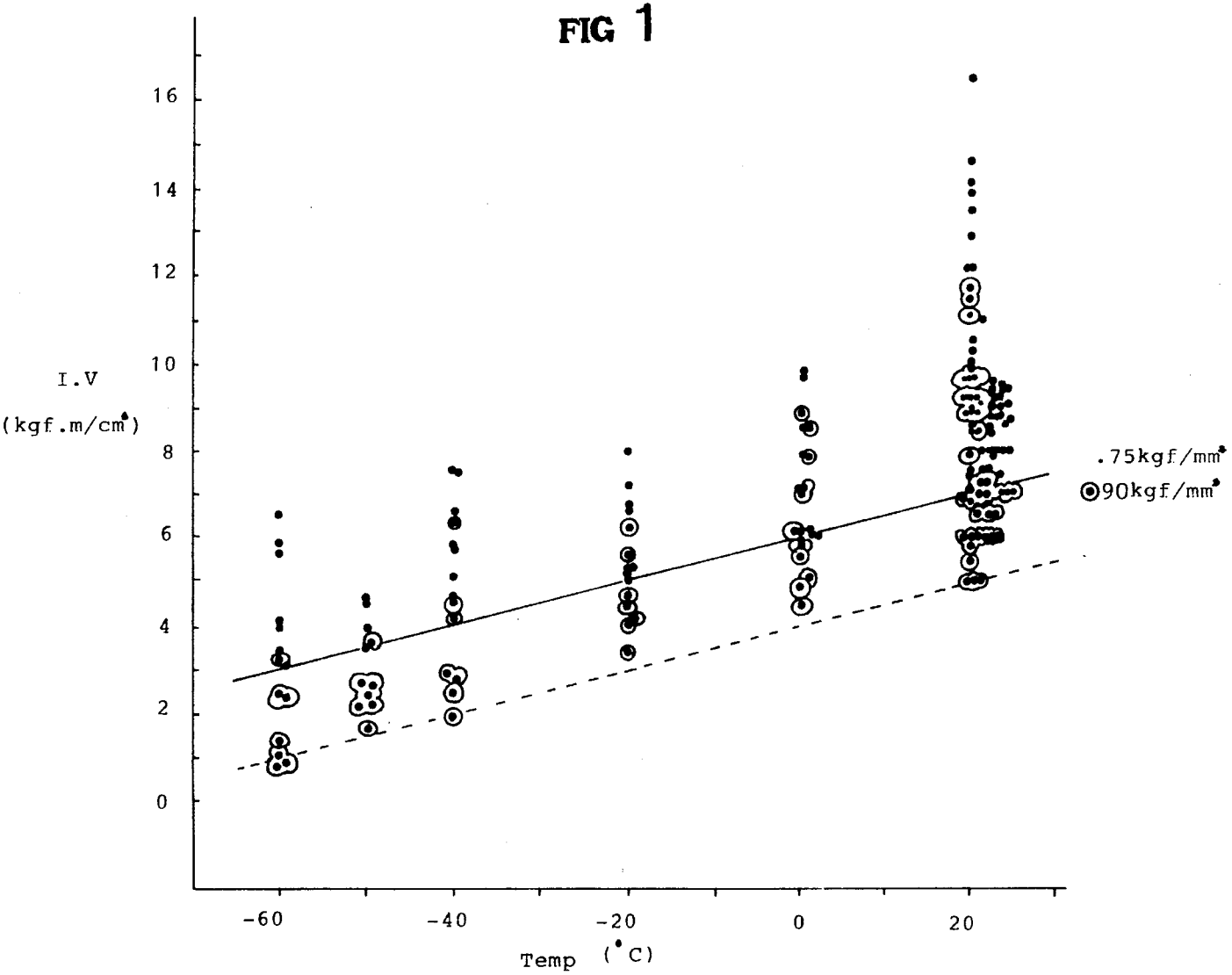
Figure 2:
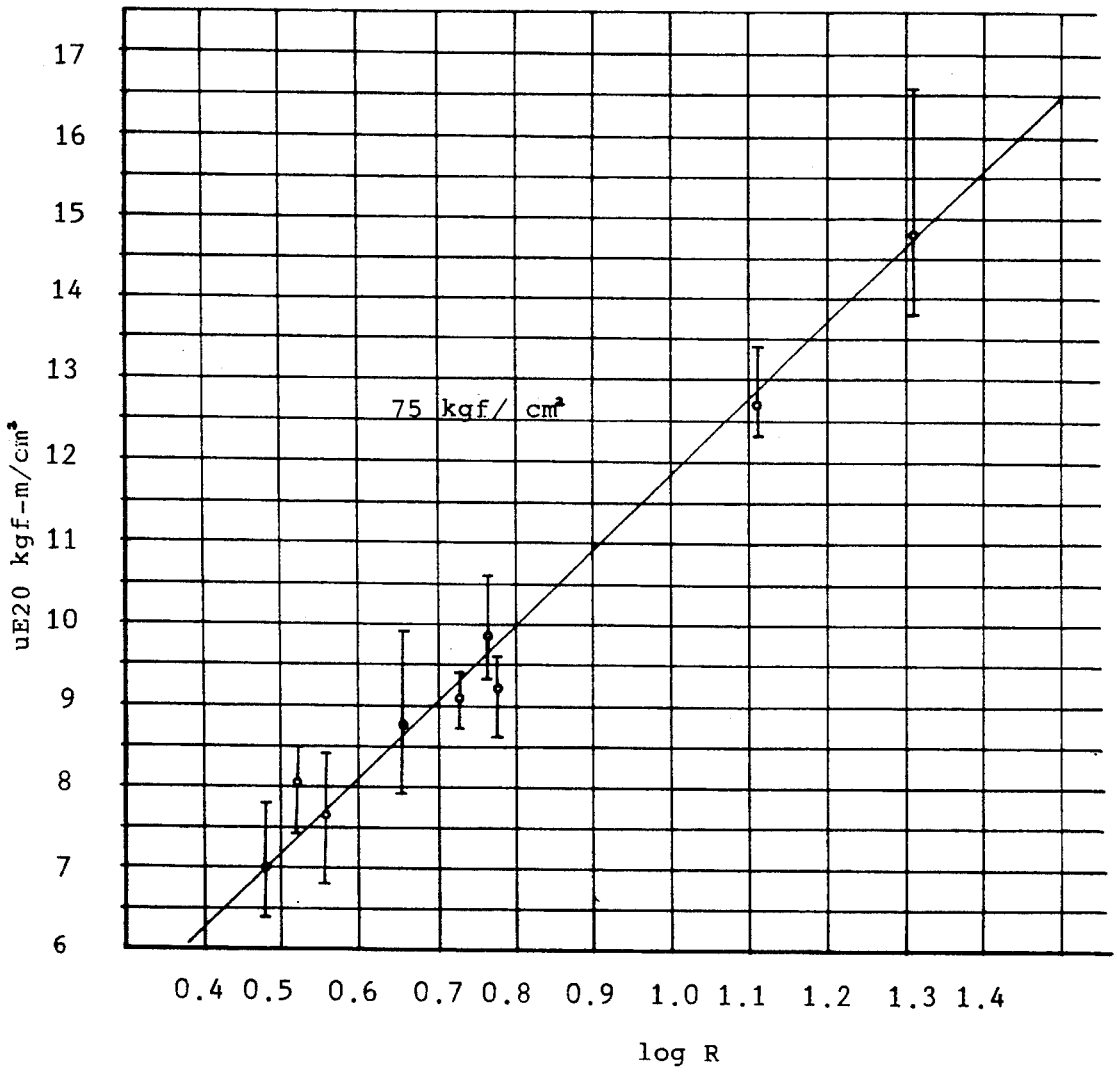
Figure 3:
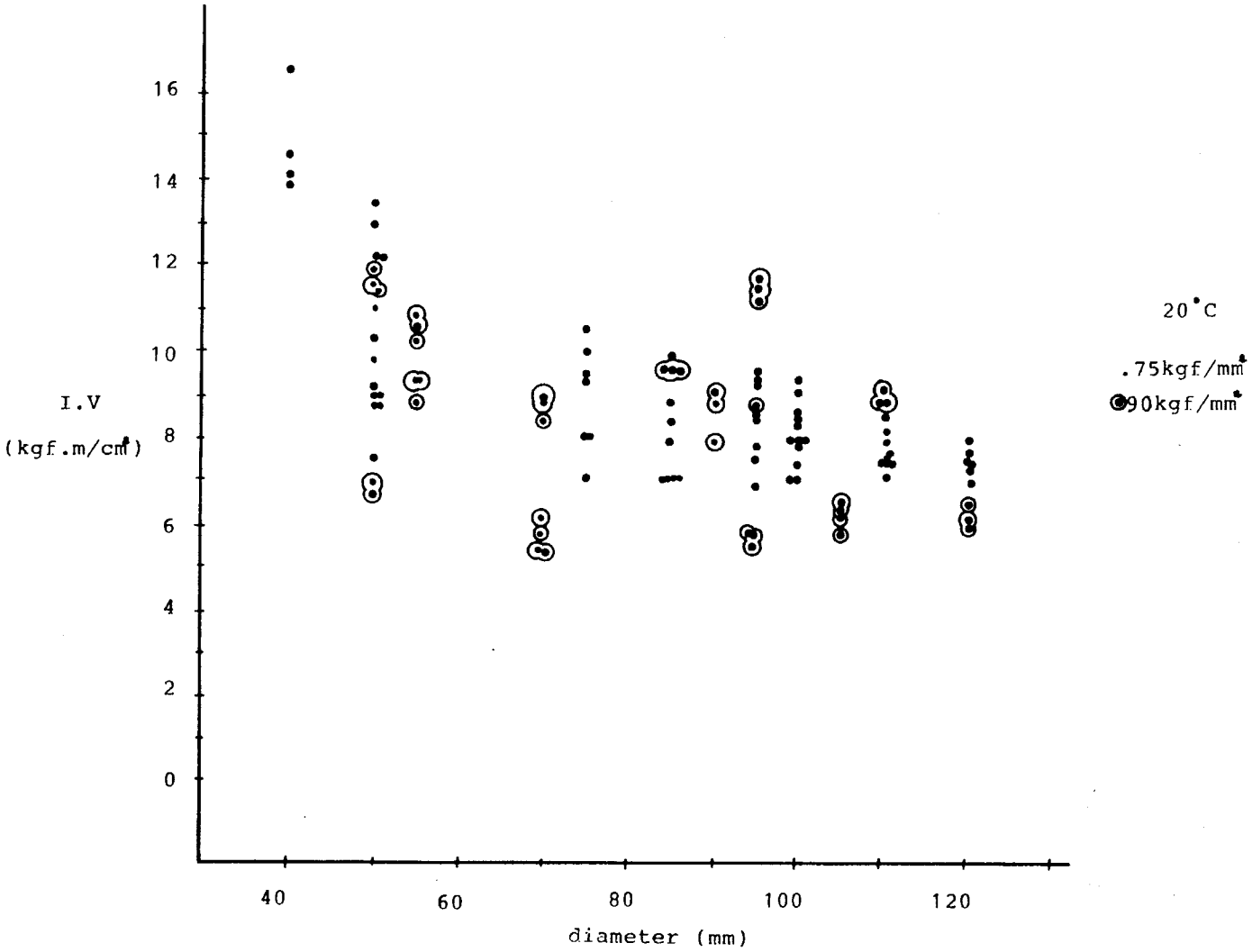

The characteristic features of the present invention will become more apparent from the description given in further detail hereinbelow with reference to the accompanying drawings, in which FIG. 1 is the graph showing impact toughness versus temperature(T), FIG. 2 is the graph representing impact toughness versus the degree of roiling(R), and FIG. 3 is the graph showing impact toughness versus size(T).

Most of conventional untempered steel exhibits the tensile strength higher than 75 kgf/mm$^2$ and the impact toughness higher than 4 kgf-m/cm$^2$, but the assurance limit is often less than said levels by its size.

Since the high toughness and high strength are required for the light weight product, the manufactured product with the tensile strength higher than 75 kgf/mm$^2$ and the impact toughness higher than 7 kgf-m/cm$^2$ has to be used in the places subject to high impact. It is because high toughness is required due to the low temperature brittleness of material in the cold weather places such as Russia or North Canada. For example, the material with the impact toughness of 4 kgf-m/cm$^2$ or so was fractured in winter in Scandivian penninsula, which indicates that in order to be used for the heavy equipment under low temperature, the tensile strength higher than 75 kgf/mm$^2$ and the impact toughness higher than 7 kgf-m/cm$^2$ are required.

However, since the impact toughness is affected by both the elongation and the strength, the balance between tensile strength and impact toughness is very important.

The inventor could draw cut the equations to meet said relationship as follows:

$$I.V=0.05T+6 \quad (1)$$

$$I.V=0.05T+4 \quad (2)$$

Here, I.V is the abbreviation of impact value at the room temperature and can be obtained from the specimen KS 3(JIS 3) with the unit of kgf-m/cm$^2$. T means temperature in centigrde. The equations above can be used to deduce the impact toughness of material used under the given temperature, where the equation 1 is applied in the class of the tensile strength of 75 kgf/mm$^2$ or so, and the equation 2 in the class of the tensile strength of 90 kgf/mm$^2$ or so, respectively(Refer to FIG. 1).

Also, there has been problem that the toughness assurance higher than 3 kgf-m/cm$^2$ is difficult to achieve in the products which require the tensile strength higher than 90 kgf/mm$^2$. In order to solve this problem, the heat-treatment(quenching+tempering) has been applied to SCr440 or SCM440. However, since the high toughness and high strength untempered steel is manufactured in the present invention, there is great advantage in terms of manufacturing cost.

To meet said advantage, the degree of rolling of material is very important as well as the rolling temperature, particularly the degree of rolling during the final rolling after intermediate heating. The present inventor has drawn out the following equation to calculate the effect of said factors on the toughness based on the experimental results.

$$I.V=9.4 \log R+2.5 \quad (3)$$

Here, R represent the degree of rolling during the final rolling, which has the same meaning as the work-hardening ratio, S (Refer to FIG. 2).

When the impact toughness is compared with the size, it can be seen that the smaller the size, the higher the impact toughness, which can be deduced to be the effects of degree of rolling and cooling rate (FIG. 3), $$I.V=7.5-23.5C * 1.3Si+1.5Mn+0.5(Cr+V)+21.1Al+66.7Ti+31.2S-$$

$$0.5Nb+9.4\ \log R-0.06(T'-850)$$

Here, T' is the temperature after the final rolling, by which the impact toughness can be deduced.

In the following, the reason why the composition of each element has been limited as described in the above will be explained.

In the class of tensile strength of 75 kgf/mm$^2$, carbon, C is the essential element required to obtain the desired strength and hardness, and has to be present at a concentration above 0.35% by weight(hereinafter, % means % by weight) in order to achieve the tensile strength higher than 75 kgf/mm$^2$ and the surface hardness higher than HRC 50 by the high frequency induction hardening. However, the impact toughness higher than 7 kgf-m/cm$^2$ is difficult to achieve with C above 0.45% due to the increase in brittleness, and the carbon composition is limited to below 0.45%.

Si acts as the important deoxidizer during the steel-making process and causes the ferrite strengthening effect, for which the Si composition more than 0.15is required. However Si more than 0.35% makes the pearlite formation difficult resulting in the low strength, and the Si composition is limited to below 0.35%.

Mn is the effective element for improving strength and assuring toughness, and acts as an important desulfurizer during the steel-making process. Particularly, in the present invention, the precipitation of MnS is induced due to the active MnO sites, which improves the machinability and the toughness by activating the pearlite formation. For assuring the strength, it is added above 0.80% up to the maximum 1.50%, of which the amount added is inversely proportional to the carbon amount added. However since the Mn compositon above 1.5% decreases the machinability and weldability, it is limited to below 1.50%.

S is inevitably incorporated during the steel -making process and forms the sulfurized compound with a law plastic deformation temperature, which is the reason why it is limited to below 0.035% in the conventional steel. However, as described in the above, since S in the present invention not only causes the improving effect of machinability, but increases the toughness by forming the ferrites within the pearlite grains, it is added above at least 0.005%. But it is limited to below 0.050%, because above 0.05%, electroplating property, the fatigue strength, and tensile strength are decreased due to the excessive inclusions.

Cr is solid-solutioned in the ferrite by small amount and if necessary effectively contributes to the strengthening and stabilization. But Cr of more than 0.3% may deteoriorate the toughness and is limited to less than 0.3%.

Al acts as the strong deoxidizer during the steel-making process, and when it forms the nitrides with N, it contributes to the reduction in grain size and the improvement of toughness. Al less than 0.01% makes it difficult to achieve the sufficient deoxidization, and At more than 0.05% readily causes the plastic deformation by being incorporated by small amount into $SiO_2$, resulting In not only the decrease in machinability and cleaness due to the non-metallic inclusions, but the deteorioration of electroplating quality due to the macrostreak flaws formed by the excessive oxides.

V forms the carbides and nitrides and contributes to the strength and toughness by small amount, assuring effectively the strength.

Nb also forms the carbides and nitrides and particularly, retards the recrystallization growth of austenite during the hot-working above 1000° C. with the result of increasing the strength de to the microscopic precipitation after transformation. Accrodingly, both V and Nb improves the strength and toughness, but the satisfactory effect appears when Nb in the range of from 0 to 0.05% is added with V and the total amount of V and Nb is in the range of 0.05~0.20%, without doing harmful effect on the weldability.

Ti has strong attraction with N forming nitrides, and when S is added, if necessary Ti is used to suppress the BN formation to ensure the effective boron. Besides, it contributes to the formation of fine grain size of austenite and thereby improves the toughness, but decreases the machinability which is the reason why its composition is limited to a certain small amount.

N forms VN and V(CN) with V, Nb(CN) with Nb and AlN with Al. Besides, N remains as Ti(CN), TiN or snail amount of BN. The nitrides and carbon nitrides, as the formation temperatures are very high, increase the recrystallization temperature, reduce the grain size and contribute effectively to strengthening the ferrite matrix. However, said carbides and nitrides decrease the activities of C and N, and V and Nb elements are needed to obtain the satisfactory results. V element is more efficient than Nb for the V element is interstitials smaller than Nb and can be readily dispersed.

On the other hand, in the class of 90 kgf/mm$^2$, B is added less than 0.0030% when needed to increase the ferrite formation in the untempered steel and improve the hardenability. But B mere than 0.0030% may cause the segregation and brittleness, thus should be limited to less than 0.0030%.

Other impurity, P is limited to less than 0.03, since it is segregated at the grain boundaries, causing the impact toughness to decrease as well as increasing the crack sensitivity at the welding part by combining with the residual hydrogen.

Moreover, 0 is limited to less than 0.0050, since it affects adversely fatigue strength, machinability, electroplating characteristics, and weldability. In the present invention, Ca, Te, Ce or other rare earth metal or Misch metal are added in the range of from 0 to 0.004% when needed to deoxidize and control the shapes of non-metallic inclusions.

Among the defect controls which are the feature of the present invention, the control of non-metallic inclusion is performed so that dA=less than 0.20%, dB+dC=less than 0.10% and dT=0.25;% when measured using point counting method by KS D0204(1982) or JIS G 0555 (1977) microscopic inspection technique of non-metallic inclusion in steel). Here, dA, dB, dC, and dT are the points counted of A type, B type, C type, and A+B+C, respectively A type inclusions are formed by viscous deformation during and can include sulfides and silicates. B type inclusions are formed of granular inclusions discontinuously and collectively disposed in the working direction and can include alumina. C type inclusions are formed by irregular dispersion without viscous deformation and can include a granular oxide.

This control of non-metallic inclusions for maintaining the appropriate cleaness not only decreases the failures that the unelectroplated parts produce during the electroplating process, but improves the fatigue strength and toughness. It is well known that the non-metallic inclusion affects the fatigue strength. As for the macrostreak flaw which affect macroelectroplating quality, KS D0208 (1980) or JIS G 0556 (1977) (method of macro-streak-flaw test for steel) and ASTM E45-87 (determining the inclusion content of steel) and ASTM E45(content measurement method of inclusions in steel) are employed for the confirming inspection.

Using either the visual inspection technique after cutting the surface stepwise and polishing the surface or the magnetic particle inspection method after cutting the surface depending on the data to be obtained, the macrostreak flaws are controlled so that the total number of counts are less than 20, total length below 15.0 mm and the maximum length below 5.0 mm with JIS G 0556 (1977) on turned step-surface of bar. This data can be recorded as 20–15.0–(5.0). More preferrably, they are controlled so that the total number of counts are less than 7, total length below 15.0 mm, and the maximum length below 4.0 mm, The method of accomplishing another object of the present invention to improve the strength end toughness consists of heating and maintaining ingot or bloom at the temperature range of 1200°~1300°C., performing the rough rolling (also termed "cogging rolling," and control-rolling the intermediate member such as a billet after reheating to 950°~1250° C. with the final rolling temperature in the range of AC 3°~980° C., more preferrably, in the range of AC 3°~850° C. to obtain the work-hardened pearlite, also termed "prior ferrite," and fine austenite.

In more detail, said method to improve both the strength and toughness consists of making the steel of the composition for the untemperd steel application according to the present invention in the commercial steel making furnace, heating and maintaining ingot or continuous cast steel for a certain time at the temperature range of 1200°~1300° C. to remove the dendrite segregation and casting flaws, performing the rough or cogging rolling to make the structure sound, and control-rolling the intermediate member after reheating to 950°1250° C. with the final rolling temperature in the range of AC 3°980° C. to obtain the work-hardened pearlite end fine austenite. If the temperature is above 980° C., the precipitates such as carbides and nitrides are melted and solid solutioned, which makes it difficult to suppress the crystal growth resulting in lowering the impact toughness.

In said method, when the direct normalizing is employed at the place of the control-rolling, it may use the method that consists of the general rolling with the final rolling, reheating to and maintaining at AC 3°~980° C. for a certain time, and control-cooling at the rate of 50°~120° C./min. Also, when the work-hardening methods such as forging and pressing are employed, the same procedure as said method is followed to control the temperature in order to obtain the satisfactory results, which is also included in the features of the present invention.

According to the microstructural characteristics which is another feature of the present invention, and the temperature regulating methed described in the above, when the reduction ratio is kept above 5S, the mixture of fine ferrite and pearlite can be easily obtained particularly with the size of pearlite grain size larger than the average 5 by ASTH No. with ASTM E 112-88 (Standard Test Methods for Determining Grain Size) and the average diameter of grains smaller than 0.07 mm.

Here, the average grain sizes of pearlite and ferrite are closely related to the impact toughness of untempered steel, and according to the experiments of the inventor, it has been found that the grain size number of pearlite is proportional to the impact absorption energy of KS3 impact test specimen. Moreover, the fraction of pearlite is the principal factor to ensure the toughness so that the pearl ire more than 0.15 by surface fraction has to be maintained to ensure the impact toughness higher than 5 kgf/mm$^2$.

Furthermore, the untempered steel of the present invention is characterized in that in order to solve the resistance against the various types of repeating stresses such as flexure fatigue, tension or tension-compression fatigue and torsion fatigue, the surface flaws produced during electroplating such as unelectroplated edge and pinhole, weldability, and the surface crack due to the crack sensitivity accompanied with the high frequency induction hardening, the flaws contents such as non-metallic inclusion, macrostreak flaw, and surface flaw are controlled.

In the following, the features of the present invention will be shown in more detail with reference to the examples but they are not limiting the scope of the present invention.

EXAMPLES 1~4

The compositions as shown in table 1 were cast into ingot and bloom in the electric furnace. They were heated to 1200°~1300°C. and rolled to the intermediate member, billet. The billet was reheated to 1100°~1200° C., rolled or forged into each size with the final working temperature at AC 3°~980° C., and then cooled at the rate of 60°~80° C./min over the temperature range 950°~500° C. The test specimens ere prepared from the steel products processed as described in the above. The flaws such as non-metallic inclusions, macrostreak flaws or surface flaws are shown in table 3. The tensile test and charpy impact test were performed on the specimens of which the results are shown in table 4.

Comparative Examples 4~

Except for the compositions of table 4, all the processing procedures were same as in said examples 1~4 and the specimens were prepared. The results of experiments performed identically with said examples 1~4 are shown in table 3 and table 4.

TABLE 1

| Examples | diameter | work-hardening ratio | Chemical composition (wt %) | | | | | | | | | |
|---|---|---|---|---|---|---|---|---|---|---|---|---|
| (steel type) | (mm) | (s) | C | Si | Mn | P | S | V | Nb | N | Al | Etc. |
| 1 | 38 | 90 | 0.44 | 0.29 | 1.50 | 0.021 | 0.017 | 1.121 | 0.001 | 0.0094 | 0.032 | Cr 0.15, O, 0.0012 |
| 2 | 50 | 52 | 0.42 | 0.28 | 1.42 | 0.017 | 0.021 | 0.014 | — | 0.0123 | 0.027 | B O. 0.0010, Cr 0.14 |
| 3 | 85 | 22 | 0.45 | 0.31 | 1.44 | 0.014 | 0.032 | 0.082 | 0.011 | 0.0104 | 0.019 | Ti 0.008–9, Cr 0.16 |
| 4-1 | 70 | 31 | 0.48 | 0.29 | 1.47 | 0.019 | 0.020 | 0.124 | — | 0.0120 | 0.035 | Cr 0.17 |
| 4-2 | 95 | 17 | | | | | | | | | | O 0.0013 |
| 4-3 | 105 | 14 | | | | | | | | | | |
| 5 | 75 | 18.2 | 0.40 | 0.35 | 1.05 | 0.022 | 0.009 | 0.082 | — | 0.0133 | 0.032 | Cr 0.18, O 0.0043 |
| 6 | 100 | 28.0 | 0.39 | 0.24 | 0.92 | 0.016 | 0.015 | 0.103 | 0.032 | 0.0068 | 0.025 | Cr 0.16, O 0.0032 |
| 7 | 120 | 19.4 | 0.40 | 0.32 | 1.23 | 0.013 | 0.008 | 0.074 | 0.021 | 0.0137 | 0.020 | CrO 0.10, O 0.0045 |

TABLE 2

| Comparative examples (steel type) | diameter (mm) | work-hardening ratio (s) | Chemical composition (wt %) C | Si | Mn | P | S | V | Nb | N | Al | Etc. |
|---|---|---|---|---|---|---|---|---|---|---|---|---|
| 1 | 85* | 22 | 0.46 | 0.35 | 1.40 | 0.016 | 0.015 | 0.128 | — | 0.0082 | 0.023 | Cr 0.15, O 0.0012 |
| 2 | **25 | ***5 | 0.44 | 0.17 | 1.05 | 0.013 | 0.010 | 0.087 | 0.022 | 0.0117 | 0.022 | Cr 0.10, O 0.0019 |
| 3 | •100 | — | 0.46 | 0.21 | 0.68 | 0.023 | 0.017 | — | — | — | | — |
| 4 | ••110 | — | 0.42 | 0.25 | 0.74 | 0.018 | 0.014 | — | — | — | | Cr 0.92, Mo 0.24 |

*Reheating to 900° C. maintaining for 3 hrs. after final rolling and then cooled to 500° C. at the rate of 80° C./min
**Forging Ø95 material to knuckles for automobile and then cooling to 500° C. by 80° C./min
***Forge to product with height of 130 mm and average thickness of 25 mm
•SM45C - Oil quenching (900° C.) - tempering (500° C.) - Comparative material
••SCM440 - Oil quenching (880° C.) - tempering (650° C.) - Comparative material

TABLE 3

| Examples | non-metallic inclusions dA | dB + dC | dT | macrostreak flaw | pearlite grain size (ASTM No.) | Ferrite fraction | Final rolling temperature (°C.) |
|---|---|---|---|---|---|---|---|
| 1 | 0.15 | 0.03. | 0.18 | 4-5-(2) | 9.0 | 0.28 | 950 |
| 2 | 0.16 | 0.01. | 0.17 | 0-0-(0) | 9.5 | 0.32 | 880 |
| 3 | 0.12 | 0.02. | 0.14 | 3-4-(2) | 7.0 | 0.25 | 850 |
| 4-1 | 0.05 | 0 | 0.05 | 0-0-(0) | 7.5 | 0.24 | 850 |
| 4-2 | 0.06 | 0 | 0.06 | 0-0-(0) | 6.5 | 0.21 | 870 |
| 4-3 | 0.08 | 0 | 0.08 | 0-0-(0) | 6.5 | 0.17 | 810 |
| 5 | 0.06 | 0.08. | 0.16 | 0-0-(0) | 7.0 | 0.25 | 850 |
| 6 | 0.02 | 0.07. | 0.09 | 0-0-(0) | 6.0 | 0.23 | 850 |
| 7 | 0.04 | 0.10 | 0.14 | 2-4-(3) | 6.5 | 0.28 | 850 |
| comparative example 1 | 0.15 | 0.01 | 0.16 | 2-2-(1) | 7.0 | 0.22 | 980 |
| comparative example 2 | 0.12 | 0.02 | 0.14 | 2-2-(1) | 5.5 | 0.15 | 980 |
| comparative example 3 | 0.14 | 0.08 | 0.22 | 6-10-(6)* | 6.0 | 0.24 | — |
| comparative example 4 | 0.09 | 0.04 | 0.13 | 3-5-(3) | — | — — | — |

Final rolling temperature was measured using infrared thermometer.
Macrostreak flaws were inspected MPI 1000 Amp.
*Detect linear defects after electroplating
1, 3, 4-1, and comparative example 3 are Cr-plated to 25 μm thickness
(Free from defects except for the steel of comparative example 3.)

From the results as shown in the above, it has been found that the mechanical properties and fatigue durability as described in the above can be met hen the non-metallic inclusions are control led so theft dA is less than 0.5%, dB+dC is less than 0.10, and dT Is less than 0.25%. For the same reason, the macrostreak flaws should be controlled to be less than 20–15–(5), more preferrably less than 7–15–(4), to obtain the satisfactory electroplating characteristics and fatigue durability. The grain size of pearlite should be homogeneous, fine and larger than ASTH No. 5 when measured using x100 microscope after corrosion treatment using nital corrosion solution(3~5%) in order to meet the required impact characteristics and high frequency induction hardening characteristics. And more than 15% of ferrite was required to ensure the impact toughness. The final rolling should be performed at 800°~980° C. with the ratio more than 10% to meet the required mechanical properties, especially the impact toughness.

TABLE 4

| Examples | tensile strength Kg f/mm$^2$ | yield strength (MPa) | elongation | reduction in surface % | impact toughness kg f-m/cm$^2$ (20° C.) | Etc. |
|---|---|---|---|---|---|---|
| 1 | 92.1(903). | 62.3(611) | 22.3 | 53.4 | 13.2 | this invention |
| 2 | 95.8(940). | 64.4(632) | 20.7 | 57.1 | 15.9 | this invention |
| 3 | 93.2(914). | 61.1(599) | 18.3 | 45.0 | 6.1 | this invention |
| 4-1 | 94.1(923) | 62.0(599) | 21.8 | 47.2 | 6.8 | this invention |
| 4-2 | 94.2(924) | 61.5(603) | 22.2 | 49.4 | 6.3 | this invention |
| 4-3 | 97.3(954) | 65.7(644) | 20.2 | 40.9 | 6.4 | this invention |
| 5 | 84.4(828) | 57.3(562) | 21.2 | 46.9 | 9.1 | this invention |
| 6 | 82.6(810) | 56.5(554) | 20.1 | 45.9 | 8.0 | this invention |
| 7 | 87.1(854) | 58.4(573) | 19.4 | 47.1 | 7.5 | this invention |
| comparative example 1 | 90.8(890) | 58.1(570) | 16.7 | 46.5 | 5.7 | conventional steel |
| comparative example 2 | 98.0(961) | 72.3(709) | 17.5 | 39.0 | 5.4 | conventional steel |
| comparative example 3 | 71.2(698) | 45.3(444) | 22.9 | 53.5 | 8.7 | SM45C-QT |
| comparative example 4 | 86.7(850) | 68.4(671) | 19.5 | 55.4 | 7.3 | SM440-QT |

tensile test specimen: KS 4
impact test specimen: KS 3

As described in the above, the untempered steel of the present invention exhibits higher strength than the conventional untempered steel with the higher allowable stress in design. The high strength and high toughness untempered steel of which the light weight product can be made has more advantages in terms of the manufacturing cost and application when compared with the tempered steel and the untempered steel of low strength.

Accordingly, the untempered steel of the present invention can be applied to the fix pin and shaft of heavy equipment and the rod of hydraulic cylinder as well as the automobile parts such as the knuckle and torsion bar. Also, the present invention can decrease the failure rate of the manufactured products in terms of the electroplating characteristic, high frequency induction hardenability, and weldability.

What is claimed is:

1. A process for producing untempered steel which has strength higher than 75 kgf/mm$^2$ and charpy impact toughness higher than 7 kgf-m/cm$^2$, comprising the steps of:

providing steel including by weight percent 0.35 to 0.45% C, 0.15 to 0.35% Si, 0.80 to 1.50% Mn, 0.005 to 0.05% S, 0 to 0.30% Cr, 0.01 to 0.05% Al, 0.05 to 0.15% V plus Nb, 0 to 0.03% Ti, 0.006 to 0.020% N, less than 0.03% P, less than 0.0050% O, and the balance Fe plus impurities inevitably added during the steel-making process;

heating an ingot or bloom to solute segregation or casting defect at a temperature range of 1200° to 1300° C.;

performing a rough rolling of said ingot or bloom; and performing a control rolling with cooling from an initial temperature range of 950° to 1250° C. to a final temperature range of AC3 to 980° C.

2. A process for producing untempered steel as claimed in claim 1, further including the step of reducing the final control rolling temperature to the range of AC3 to 850° C. to obtain work-hardened ferrite and fine austenite.

3. A process for producing untempered steel as claimed in claim 1, wherein during said control-rolling, a general rolling is performed and maintained at AC to 980° C. for a predetermined time until the surface and interior of the billet reach the same temperature and thereafter the control-cooling is performed at a rate of 50° to 120° C./min.

4. A process for producing untempered steel as claimed in claim 1, further including the step of controlling non-metallic inclusions of said untempered steel, such that dA is less than 0.20%, dB+dC is less than 0.10%, and dT is less than 0.25% by a microscopic testing method of non-metallic inclusions in steel, to thereby improve impact toughness and electroplating characteristics.

5. A process for producing untempered steel as claimed in claim 13, wherein the work-deformed ratio of said untempered steel is above a five times reduction ratio to achieve an ASTM grain size number of an average pearlite grain size higher than 5.

6. A process for producing untempered steel as claimed in claim 13, further including the step of controlling macrostreak flaws of said untempered steel to be less than 20-15.0-(5.0) by a visual inspection method, to thereby improve the fatigue strength and the electroplating characteristics.

7. A process for producing untempered steel as defined in claim 6, which has higher fatigue strength and good electroplating characteristics wherein macrostreak flaws of said untempered steel are controlled to be essentially less than 7-15.0-(4.0).

8. A process for producing untempered steel which has strength higher than 90 kgf/mm$^2$ and charpy impact toughness higher than 5 kgf-m/cm$^2$, comprising the steps of:

providing steel including by weight percent 0.40 to 0.50% C, 0.25 to 0.65% Si, 1.00 to 1.60% Mn, 0.005 to 0.050% S, 0 to 0.30% Cr, 0.01 to 0.05% Al 0.05 to 0.20% V plus Nb, 0 to 0.03% Ti, 0.006 to 0.020% N, less than 0.03% P, less than 0.0050% O, and Fe plus impurities which are inevitably incorporated during the steel-making process;

heating an ingot or bloom to solute segregation or casting defect at a temperature range of 1200° to 1300° C.;

performing a rough rolling of said ingot or bloom; and performing a control rolling with cooling from an initial temperature range of 950° to 1250° C. to a final temperature range of AC3 to 980° C.

9. A process for producing untempered steel as claimed in claim 8, further including the step of reducing the final control rolling temperature to the range of AC3 to 850° C. to obtain a work-hardened ferrite and fine austenite.

10. A process for producing untempered steel claimed in claim 8, wherein instead of said control-rolling, a general rolling is performed and maintained at AC to 980° C. for a predetermined time until the surface and the interior of the billet reach the same temperature and thereafter the control-cooling is performed at the rate of 50° to 120° C./min.

11. A process for producing untempered steel as claimed in claim 8, further including the step of controlling the non-metallic inclusions of said tempered steel such that dA is less than 0.20%, dB+dC is less than 0.10%, and dT is less than 0.25% by a microscopic testing method of non-metallic inclusions in steel, to thereby improve the impact toughness and the electroplating characteristics.

12. A process for producing untempered steel as claimed in claim 20, wherein the work-deformed ratio of said untempered steel is above a five times reduction ratio to achieve an ASTM grain size number of the average pearlite grain size higher than 5.

13. A process for producing untempered steel as claimed in claim 8, further including the steps of controlling macrostreak flaws of said untempered steel so as to be less than 20-15.0.(5.0) by a visual inspection method, to thereby improve the fatigue strength and the electroplating characteristics.

14. A process for producing untempted steel as claimed in claim 13, which has higher fatigue strength and good electroplating characteristics wherein macrostreak flaws of said untempered steel are controlled to be essentially less than 7-15.0.(4.0).

15. A process for producing untempered steel as claimed in claim 6, wherein Nb is 0 to 0.05% by weight percent.

16. A process for producing untempered steel as claimed in claim 8, wherein Nb is 0 to 0.05% by weight percent.

* * * * *